United States Patent [19]

Boyce

[11] Patent Number: 4,717,184

[45] Date of Patent: Jan. 5, 1988

[54] SAFETY LATCH FOR DRAWERS AND THE LIKE

[76] Inventor: Phil Boyce, 2133 Research Dr., Livermore, Calif. 94550

[21] Appl. No.: 743,068

[22] Filed: Jun. 10, 1985

[51] Int. Cl.[4] ..... E05C 17/14

[52] U.S. Cl. ..... 292/87; 292/262

[58] Field of Search ..... 292/80–87, 292/19, 262, 101, 107, DIG. 4; 217/60 C, 60 D

[56] References Cited

U.S. PATENT DOCUMENTS

| | | | |
|---|---|---|---|
| 1,303,441 | 5/1919 | Wilton | 217/60 C |
| 3,621,684 | 11/1971 | Horvay et al. | 292/87 X |
| 3,694,015 | 9/1972 | Gley | 292/80 |
| 3,713,682 | 1/1973 | Feller | 292/80 |
| 3,850,463 | 11/1974 | Hawkins | 292/67 |
| 3,879,072 | 4/1975 | Tuley | 292/87 |
| 3,888,525 | 6/1975 | Kousens | 292/87 |
| 3,889,992 | 6/1975 | Shelton | 292/87 |
| 3,918,752 | 11/1975 | Leone et al. | 292/174 |
| 3,971,237 | 7/1976 | Rasmussen | 70/99 |
| 4,139,249 | 2/1979 | Hillman | 312/333 |
| 4,378,948 | 4/1983 | Chrones | 292/19 |
| 4,416,477 | 11/1983 | Bialobrzeski et al. | 292/87 X |
| 4,505,526 | 3/1985 | Leck | 312/333 |
| 4,588,220 | 5/1986 | Matsui et al. | 292/338 |

FOREIGN PATENT DOCUMENTS

| | | | |
|---|---|---|---|
| 128810 | 7/1950 | Sweden | 292/87 |
| 131542 | 8/1919 | United Kingdom | 217/60 D |

*Primary Examiner*—Richard E. Moore

[57] ABSTRACT

A child resistant safety latch for the door or drawer of an enclosure such as a cabinet. The door or drawer is latched in a slightly ajar position from which it can neither be fully opened nor reclosed, preventing both access to the contents of the enclosure and possible injury to the child's fingers upon reclosure.

9 Claims, 4 Drawing Figures

SAFETY LATCH FOR DRAWERS AND THE LIKE

BACKGROUND OF THE INVENTION

1. Field of the Invention

This invention relates to latches for enclosures such as cabinets or drawers, and more particularly to latches that are intended to prevent injury to children.

2. Description of the Prior Art

There are many types of safety latches for securing drawers and doors. A common type of latch is one which permits only partial opening of a drawer unless the latch is released so as to permit a complete opening. This type of latch is described in U.S. Pat. Nos. 3,850,463, 3,879,072, 3,889,992, 3,971,237, 4,139,249, 4,378,948, 4,416,477, and 3,918,752.

The safety latches of the prior art include a hook flexibly attached to the movable member of the closure (the door or drawer) and a stop attached to the closure housing (the door frame or drawer frame). These latches prevent the door or drawer from being fully opened unless the hook attachment is disengaged from the stop. The purpose the latches of the prior art is to prevent a child from opening a drawer or door completely and thereby accessing the contents stored within.

A problem that the prior art does not address is the reclosure of the drawer or door from a partially open position. This leads to the dangerous situation whereby a child partially opens a drawer or door, and then recloses it on his or her fingers.

SUMMARY OF THE INVENTION

An object of this invention is to provide a latch for the moving member of an enclosure.

Another objective is to provide a latch which will prevent movement of the movable member from a closed position beyond a fixed ajar position unless the latch is intentionally disengaged.

A still further objective is to provide a latch which will secure the movable member in the ajar position so that the movable member cannot be closed until the latch is intentionally released, thereby preventing possible injury to the child.

Briefly, the latch of this invention comprises a hook which is flexibly attached to the movable member of the closure and a catch attached to the closure housing. The hook preferably includes a bar having a latching slot. A tang provided at an edge of the bar forms one side of the latching slot so that the entrance to the latching slot faces the catch when the movable member is closed.

The catch includes a plate with an aperture so as to provide a rim. As the hook approaches the catch from the closed position of the movable member, the tang guides the rim into the entrance to the latching slot where it is captured so as to secure the movable member from further movement in either closed or open direction.

The tang of the hook also prevents capture of the rim of the catch when the moving member is moved from the completely open position to the closed position. The flexible attachment of the hook to the moving member permits not only engagement of rim with slot as described but also manual disengagement when it is desired to release the latch in order to close or open the movable member.

A major advantage of this invention is that the latch prevents both a child's access to the contents of the enclosure, and possible injury to the child's hands by an accidental reclosure of the movable member.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
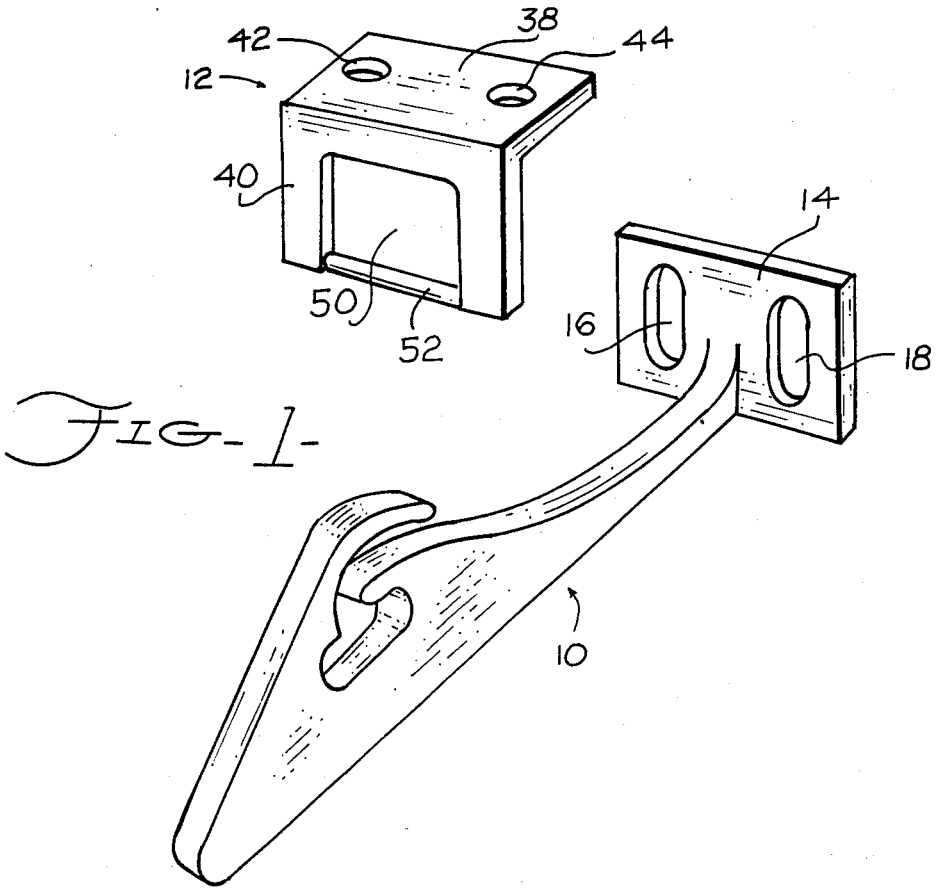
FIG. 1 shows the catch and hook in accordance with a preferred embodiment of the invention.
Figure 2:
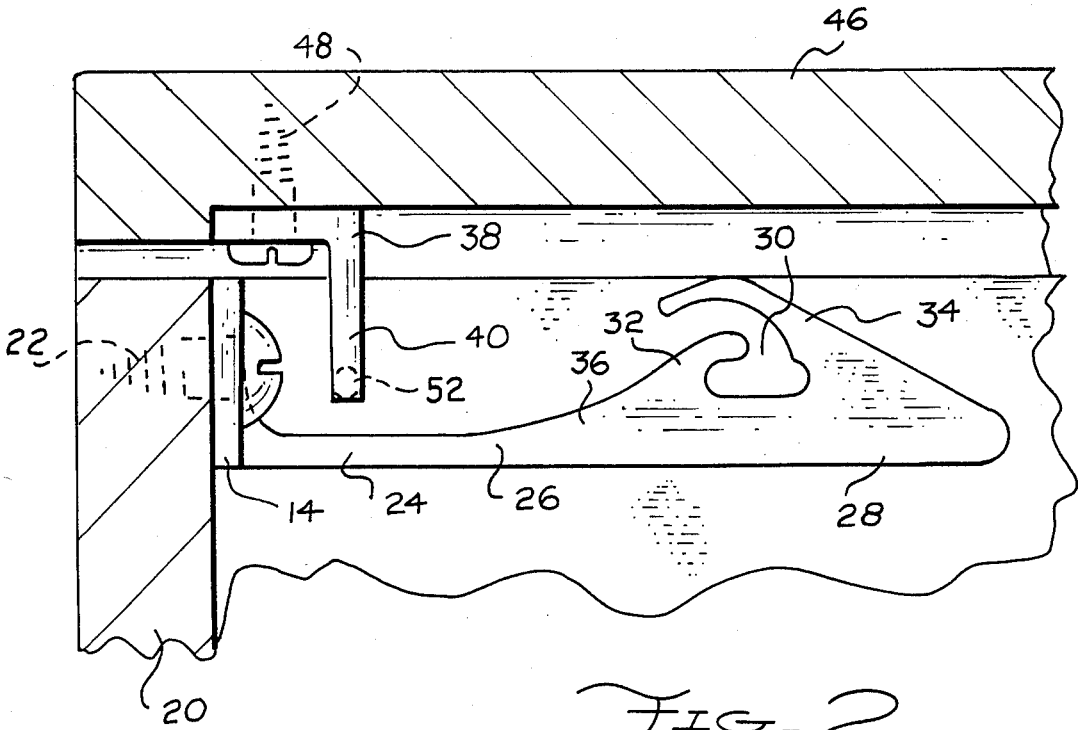
FIG. 2 shows the position of the hook and latch when the moving member is in the closed position.
Figure 3:
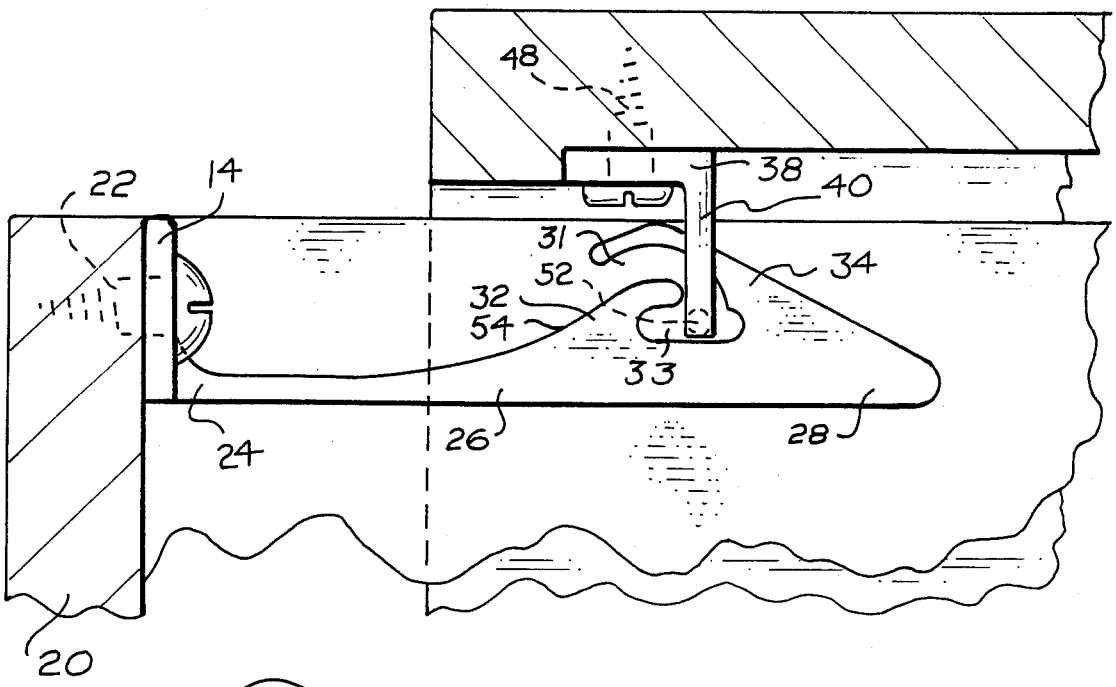
FIG. 3 shows the engagement of the hook and latch when the moving member is in the ajar position.

Referring to FIG. 1, the latch in accordance with the invention includes a hook 10 and a catch 12. At one end of the hook is a foot 14 comprising a plate provided with slots 16 and 18. As shown in FIGS. 2 and 3, the plate is attached to the movable member 20 by fastener means such as screws 22.

A bar 24 extends perpendicularly from foot 14. A length 26 of bar 24 is tapered so that the end of bar 24 that is attached to foot 14 is relatively narrow to provide flexibility. The bar 24 widens along section 26 to form the head 28 of the hook.

A latching slot 30 is formed in the head 28 by a lip 32 and a tang 34. The lip 32 extends from an elongated section 36 of the head and bends away from the foot to form one side of an arcuate leading slot portion 31 of the latching slot 30. The tang 34 extends from the elongated section 36 of the head and bends over the lip 32 toward the foot to form the second border of the leading slot portion 31 so that the latching slot 30 has an entrance that faces toward the foot 14. The leading slot portion 31 terminates at an elongated rest slot portion 33 of the latching slot 30. The rest slot portion 33 extends in a direction perpendicular to the movable member 20.

The catch is seen to include two plates 38 and 40 joined at an angle. The first plate 38 has two apertures 42 and 44 so that the catch may be attached to the closure housing 46 (see FIGS. 2 and 3) with fasteners such as screws 48. The second plate 40 has a square aperture 50 thereby forming a rim 52.

When the movable member is moved from the closed position, shown in FIG. 2, to the slightly ajar position, shown in FIG. 3, the rim 52 slides along surface 54 by virtue of the flexibility of narrow length 26, and is guided into the latching slot 30 by tang 34. The movable member is thereby secured in the ajar position until the hook 10 is intentionally disengaged from the catch 12.

Figure 4:
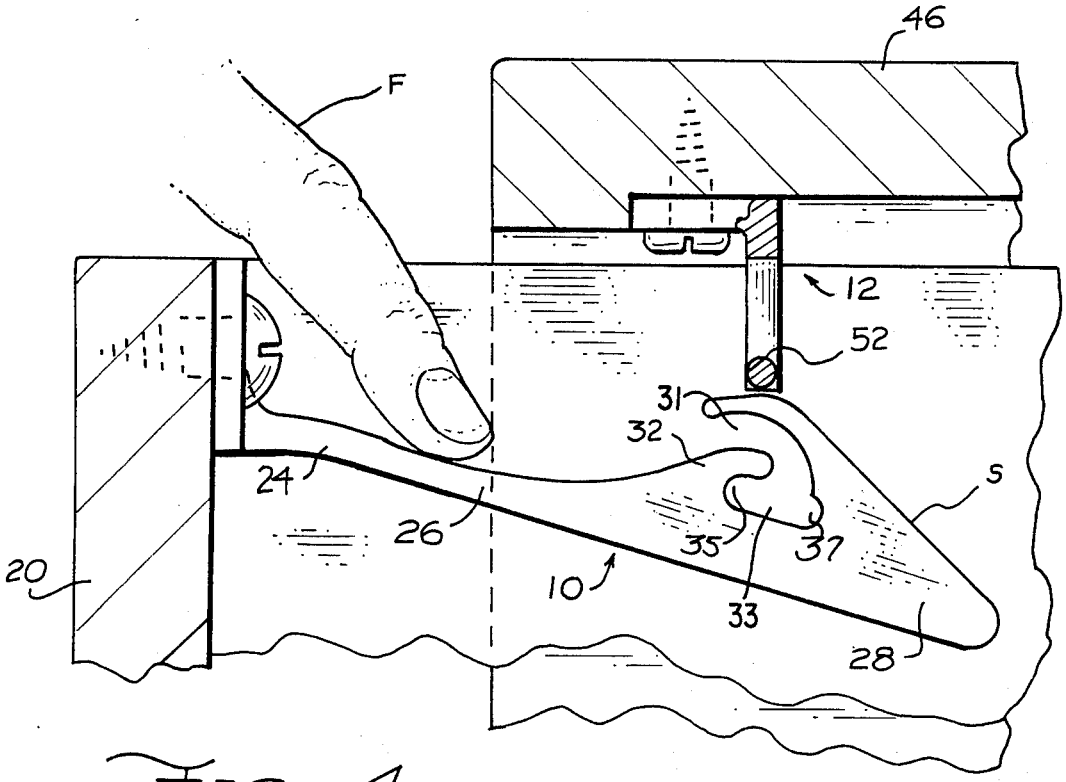
FIG. 4 shows disengagement of the hook and catch.

Referring now to FIG. 4, the hook 10 is disengaged from catch 12 by applying pressure with the index finger F to the length 26 of latch 10. This causes a downward flexure of bar 24 disengaging rim 52 of catch 12 from rest slot portion 33.

Pushing the movable member 20 inwardly toward a closed position will then disengage the rim 52 from the leading slot portion 31. A second downward flexure of the bar 24 will cause the leading slot portion 31 to be brought to a position lower than that of the rim 52. The movable member may then be pulled to an open position. Clearly, this procedure would be difficult for a child to conceptualize or to actuate. It is especially difficult for a child if, as may be seen in FIG. 4, aligning the rim 52 with the leading slot portion 31 requires purposeful action since the rest slot portion 33 has sections 35, 37 that extended in opposite directions of the intersection with the leading slot portions 31.

It should be noted that when the movable member 20 is closed from a fully open position, the upper surface S of head 28 guides the rim 52 beyond slot 30, thereby allowing movable member 20 to be fully closed. Thus, the latch of the present invention only secures the movable member in an ajar position on its initial opening, and not on its subsequent closing.

The preferred material for the hook 10 is plastic or tempered metal in so that it is sufficiently flexible. The catch 12 can similarly be made from plastic, metal, or other suitable materials.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A safety latch for securing movable members associated with enclosure housings, said latch comprising, catch means adapted for attachment to an enclosure housing for selectively securing a movable member, hook means including a foot portion adapted for attachment to said movable member and having a head portion having a latching slot, said latching slot having a leading slot portion and a rest slot portion, said leading slot portion having an entrance facing said foot portion and having a termination intersecting said rest slot portion, said rest slot portion being elongate, whereby moving said movable member from a closed position to an ajar position may engage said catch means first with said leading slot portion and subsequently with said rest slot portion for securement of said movable member in said ajar position such that the movable member can neither open nor close, said rest slot portion having a first section and a second section, said first section extending toward said foot portion from said intersection of said leading slot portion and said rest slot portion, said second section extending from said intersection and away from said foot portion, said hook means having a flexible bar portion coupling said head portion to said foot portion such that said hook means can be disengaged from said catch means by flexing said bar portion.

2. A safety latch as recited in claim 1 wherein said head portion further comprises:

a lip extending away from said foot portion to form one side of said leading slot portion;

a cantilevered tang extending towards said foot portion and over said lip, said lip and said tang being operative to guide said catch means into said latching slot when moving said movable member from said closed position to said ajar position and to guide said catch means past said latching slot when moving said movable member from a fully open position to a closed position.

3. A safety latch as in claim 2 wherein said foot portion includes a plate provided with apertures receptive to fastener means.

4. A safety latch as in claim 2 wherein said bar portion has a narrowing taper from said head portion to said foot portion, said taper providing a cam action for said hook means.

5. A safety latch as in claim 2 wherein said catch means includes a first plate receptive to fastener means joined at an angle to a second plate which has an aperture that provides a rim that may engage with the latching slot.

6. A safety latch for securing movable members associated with closure housings, said latch comprising, a catch means adapted for attachment within an enclosure housing, said catch means having a shaftlike member, and a hook member having a foot adapted for attachment to a movable member and having a flexible bar portion extending from said foot, said hook member having a head portion at an end of said bar portion opposite said foot, said bar portion having a narrowing taper from said head portion to said foot, said head portion having a lip extending away from said foot and a cantilevered tang extending toward said foot, said lip and said tang spaced apart to form an arcuate leading slot portion, said leading slot portion having an entrance facing said foot for engagement with said shaftlike member of said catch means, whereby moving said movable member from a closed position to an ajar position may engage said catch means by cam action along the bar portion and within said arcuate leading slot portion for securement of said movable member in said ajar position, said head portion having a rest slot portion intersecting said leading slot portion at an end opposite said entrance to form a latching slot, said rest slot portion being elongated and having a first section and a second section, said first section extending toward said foot from said intersection of said leading slot portion and said rest slot portion, said second section extending from said intersection and away from said foot.

7. The safety latch of claim 6 wherein said catch means includes a first plate receptive to fastener means jointed at an angle to a second plate which has an aperature that provides a rim that may engage with the latching slot.

8. The safety latch of claim 6 wherein said lip is cantilevered to form an edge of said first section of said rest slot portion.

9. The safety latch of claim 6 wherein said bar portion has a narrowing taper from said head portion to said foot, said taper providing a cam action for said hook member.

* * * * *